US008373594B1

(12) United States Patent
Wood

(10) Patent No.: US 8,373,594 B1
(45) Date of Patent: Feb. 12, 2013

(54) LOW FREQUENCY DIRECTED ENERGY SHIELDING

(75) Inventor: J. Richard Wood, Grapevine, TX (US)

(73) Assignee: Lockheed Martin Corp, Bethesda, MD (US)

( * ) Notice: Subject to any disclaimer, the term of this patent is extended or adjusted under 35 U.S.C. 154(b) by 280 days.

(21) Appl. No.: 12/512,803

(22) Filed: Jul. 30, 2009

Related U.S. Application Data

(60) Provisional application No. 61/085,245, filed on Jul. 31, 2008.

(51) Int. Cl.
*G01S 3/16* (2006.01)

(52) U.S. Cl. ..... 342/379

(58) Field of Classification Search ..... 342/379
See application file for complete search history.

(56) References Cited

U.S. PATENT DOCUMENTS 4,612,549 A * 9/1986 Geyer et al. ..... 342/379
5,001,773 A * 3/1991 White ..... 455/118
5,307,081 A 4/1994 Harmuth ..... 343/842
5,365,234 A * 11/1994 Lewis ..... 342/16
5,894,288 A * 4/1999 Lee et al. ..... 343/770
6,697,009 B2 * 2/2004 Yu ..... 342/17
2003/0054755 A1 * 3/2003 Zehavi et al. ..... 455/1
2003/0148748 A1 * 8/2003 Shah ..... 455/296
2005/0110683 A1 * 5/2005 Song et al. ..... 343/700 MS
2006/0057836 A1 * 3/2006 Nagarajan et al. ..... 438/622
2006/0125704 A1 * 6/2006 Melconian et al. ..... 343/779
2008/0233884 A1 * 9/2008 Chang et al. ..... 455/63.1

* cited by examiner

*Primary Examiner* — Harry Liu
(74) *Attorney, Agent, or Firm* — Lee, Jorgensen, Pyle & Kewalramani PC

(57) ABSTRACT

A method and apparatus for use in generating and imparting a low frequency, directed energy wavefield are disclosed. In a first aspect, the presently disclosed technique includes a low frequency directional array, comprising: a plurality of array elements capable of generating a low frequency, directed energy wavefront; and a canceling element capable of actively canceling a spurious lobe of the wavefront. In a second aspect, the presently disclosed technique includes a method, comprising: imparting a low frequency, directed wavefront; and actively canceling a spurious lobe of the wavefront.

13 Claims, 4 Drawing Sheets

LOW FREQUENCY DIRECTED ENERGY SHIELDING

Priority to the earlier effective filing date of U.S. Provisional Application 61/085,245, entitled "Low Frequency Directed Energy Shielding", and filed Jul. 31, 2008, in the name of the inventor J. Richard Wood is hereby claimed under 35 U.S.C. §119(e). The '245 application is also hereby incorporated by reference in its entirety and for all purposes.

BACKGROUND OF THE INVENTION

1. Field of the Invention

The present invention pertains to low frequency directed energy applications, and, more particularly, to shielding used in such applications.

2. Description of the Related Art

This section of this document is intended to introduce various aspects of the art that may be related to various aspects of the present invention described and/or claimed below. This section provides background information to facilitate a better understanding of the various aspects of the present invention. As the section's title implies, this is a discussion of related art. That such art is related in no way implies that it is also prior art. The related art may or may not be prior art. It should therefore be understood that the statements in this section of this document are to be read in this light, and not as admissions of prior art.

One type of system with a long history is known as an "area denial" or "active area denial" system. These weapons typically prevent people from occupying a selected area. Many of these types of systems are commonly recognized in popular culture. In a combat context, these include sharpened stakes, razor wire, and land mines. However, area denial systems also find many civilian contexts. For example, barbed wire is commonly used to control livestock and secure businesses. Thus, many of these types of systems are "nonlethal".

Some kinds of area denial systems include directed energy of a low frequency radiating from an array of energy sources. To protect the personnel deploying and using these systems, the array includes shielding that blocks the energy from radiating in the direction of the personnel. Current shielding approaches include shielded loops with laminated discs to provide low frequency radiation with directional fields.

The present invention is directed to resolving, or at least reducing, one or all of the problems mentioned above.

SUMMARY OF THE INVENTION

In a first aspect, the presently disclosed technique includes a low frequency directional array, comprising: a plurality of array elements capable of generating a low frequency, directed energy wavefront; and a canceling element capable of actively canceling a spurious lobe of the wavefront.

In a second aspect, the presently disclosed technique includes a method, comprising: imparting a low frequency, directed wavefront; and actively canceling a spurious lobe of the wavefront.

The above presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF THE DRAWINGS

The invention may be understood by reference to the following description taken in conjunction with the accompanying drawings, in which like reference numerals identify like elements, and in which:

FIG. 2A-FIG. 2C depict two alternative kinds of radiators as may be used to implement the embodiment of FIG. 1 and a material of their construction, in which:

FIG. 2A is a diagrammatic illustration of an improved radiator according to FIG. 4, that uses the material of FIG. 6 to separate the return loop (RL) from the forward loop (FL);

FIG. 2B is a diagrammatic illustration of the radiator of FIG. 1 further improved by replacing the one current loop by four series wound loops covering a predetermined surface area;

FIG. 2C is a diagrammatic illustration showing a material with high permeability in the direction of the H field and low conductivity in the direction of the E field.

Figure 1:
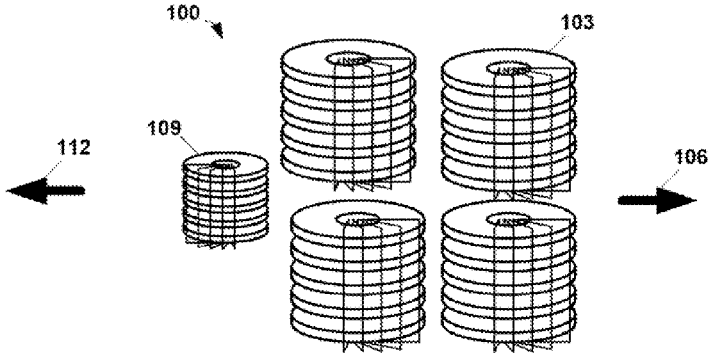
FIG. 1 illustrates one particular embodiment of a low frequency directional array constructed in accordance with the presently disclosed technique.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The presently disclosed technique employs anti-phased (i.e., reversed shielded coil loops) array elements to actively cancel the unwanted radiation remaining from the main directed energy shielded loop array. The active cancellation provides protection for equipment and personnel behind the array, or in vehicles or buildings being protected by the array.

The present invention will now be described with reference to the attached figures. Various structures, systems and devices are schematically depicted in the drawings for purposes of explanation only and so as to not obscure the present invention with details that are well known to those skilled in the art. Nevertheless, the attached drawings are included to describe and explain illustrative examples of the present invention.

FIG. 1 illustrates one particular embodiment of a low frequency directional array 100 constructed in accordance with the presently disclosed technique. The directional array comprises a plurality of array elements 103 (only one indicated) capable of generating a low frequency, directed energy wavefront (not shown). The wavefront propagates in the direction; of the arrow 106 in the illustrated embodiment. The direction is a function of the geometry of the windings on the elements and can be controlled through that geometry. The low frequency directional array 100 also comprises a canceling element 109 capable of actively canceling a spurious lobe of the wavefront.

The array elements and canceling elements may also be referred to as "large current radiators" (or, "LCR"). There are at least two kinds of radiators with which the array elements and canceling elements may be implemented. One kind is a sheet element 200, shown in FIG. 2A, and a second kind is a multi-turn loop element 203, shown in FIG. 2B. In the embodiment of FIG. 1, both the array elements 103 and the canceling element 109 comprise multi-turn loop elements 203, as shown in FIG. 2B. The principles of operation, design, construction, and operation of these two kinds of elements discussed more fully in U.S. Pat. No. 5,307,081, in which FIG. 2A-FIG. 2B appear as FIG. 7-FIG. 8, respectively. To further an understanding of the present invention, a portion of the '081 patent relating to the implementation of the radiating elements will now by excerpted with some modification.

Figure 2A:
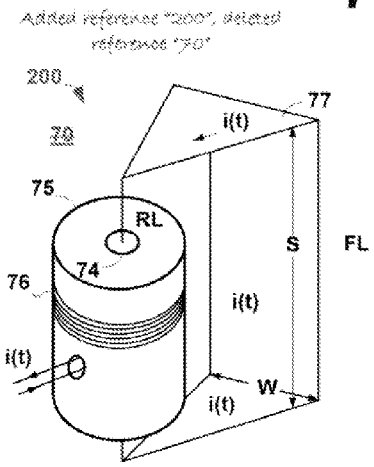
Figure 2B:
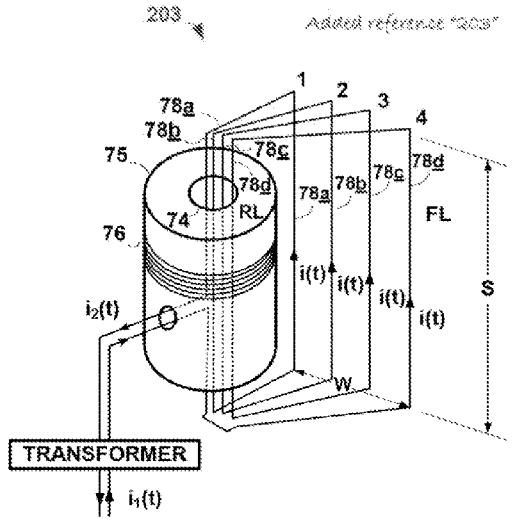
Figure 2C:
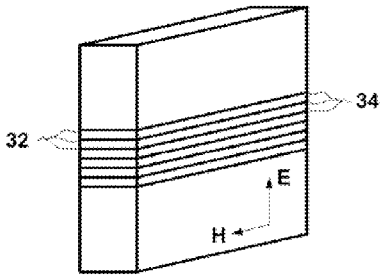

Both implementations of the array element 103 shown in FIG. 2A-FIG. 2B use the material of FIG. 2C. Examples of materials with high permeability are soft steel and advanced products available under names like Permalloy and μ-metal. Their relative permeability is typically between 10000 and 20000, which is acceptable, but their conductivity is that of metals, on the order of 10.sup.6 A/Vm. FIG. 2C shows a means for reducing the conductivity in the direction of the electric field strength. Thin sheets 32 of μ-metal are stacked with thin sheets of paper 34, or lacquer, which are used as insulation, between the layers. The electric field strength E cannot drive a current through the insulating material between the sheets of μ-metal. This is the same principle that is used in making iron cores for transformers.

Making the sheets of μ-metal in FIG. 2C very thin, results in a material with large permeability in the direction of H and essentially no conductivity in the direction of E. This is a reflective type material. Making the sheets of μ-metal thicker or using a poor insulator between the sheets, results in a material with large permeability in the direction of the H vector in FIG. 2C and low conductivity in the direction of the E vector. This is an electric field absorbing material since part or all of the wave penetrates the material and is absorbed by ohmic losses. If the stack of μ-metal is not separated by insulators at all, it becomes a material with high permeability and high conductivity in every direction. For all practical purposes, such material will act as a metallic plate whose permeability is of little consequence to the electric field. So, instead of reversing the polarity of the magnetic field strength H, it reverses the polarity of the electric field strength E. Consequently, the reflected wave tends to cancel the radiated wave.

Figure 2D:
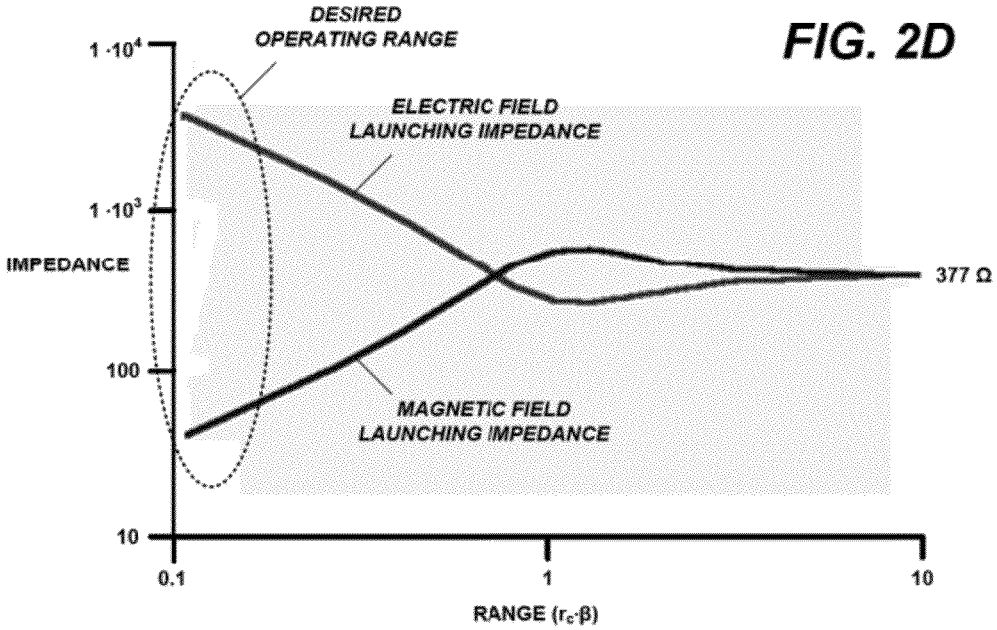
FIG. 2D graphs electromagnetic field launch impedance for the material in FIG. 2C.

The metamaterial whose fabrication is illustrated in FIG. 2C and is described above provides a low frequency, small aperture electromagnetic launch for the radiated wavefield. FIG. 2D graphs the electromagnetic field launch impedances. From FIG. 2D, it can be seen that the desired operating regime is in the region in which the electric field impedance is high while the magnetic field launch impedance is low. The lamination geometry allows strong magnetic field reflection, thereby cancelling magnetic field propagation to rear. The laminations reduce reflected E-field and permits E-field propagation toward a target.

Returning now to FIG. 2A-FIG. 2B, the return loop RL is confined to cover a small surface, and, is surrounded by a shield of high permeability, low conductivity material 75 which is composed of laminations of circular sheets of μ-metal, Permalloy material, etc. which are electrically insulated from each other by sheets of paper, lacquer, or other insulating material. A few exemplary laminations are shown at 76. Though shield 75 is illustrated in cylindrical shape, other shapes may be employed; in general, these shapes will include a variety of three-dimensional solid configurations, all having a bore 74 through which the return loop may pass. This shield acts as a reflector for low frequency electromagnetic waves and thereby allows the construction of a greatly improved radiator for high currents. It is compact, has a small value of s, can be excited with very large current pulses, and is an efficient radiator.

However, an improvement of the design of FIG. 2A is still needed to avoid having to use a current driver that can handle hundreds of kiloAmperes. FIG. 2B illustrates such an embodiment in which the one current loop 77 of FIG. 2A is replaced by n=4 series wound current loops 78*a*-78*d* that cover a large surface area. The plate 77 of FIG. 2A becomes a series of wires 78*a*-78*d* covering the same surface area s×W, while the return loops 79*a*-79*d* are crowded together into a bundle covering a relatively small surface area. Only four such loops are shown in order to simplify the drawing, but in reality there could be hundreds or even thousands of loops. The forward loops of the n wires of FIG. 2B can be geometrically arranged to cover a large area, just as the plate of FIG. 2A did. It is evident that the current ni(t) will be flowing in the large surface area "plate", implemented by n wires, if a current i(t) is delivered from the current driver.

To obtain an understanding of the practical limitations of this design, assume that s equals 1 m in FIG. 2B. If a loop is approximately square, then 4 m of wire are required per loop. Let a pulse with duration T=10 ms be radiated. Light travels 3000 km in 10 ms. 40000 m of this value is about 1.33 percent. Hence, 10000 wire loops each 4 m can be used before the delay between the beginning and the end of the wire becomes significant. If n=10,000, then a drive current of 100 A will produce a radiated current of $10^6$ A=IMA. If this is not enough, more wires in parallel can be used, for example, 10, to obtain I=10 MA. If more current is needed, a transformer can be used since the driving voltage is still quite small. However, at this time, the practical limit of the driving current, without resorting to a transformer, is not a current of 100 A, but 10 kA, since such currents are switched in electric locomotives, the chemical industry, and in rail guns. Hence, the technological limit for the radiated current is presently around I=1 GA, which is well beyond any envisioned application.

For an airborne radiator a length s=1 m and a current I=100 MA appear to be the practical limits. To determine the power these parameters represent, E×H is integrated over the surface of a half sphere at a distance r and we note that $$P(i) = \frac{1}{2} Z_0 \left(\frac{sI}{4c}\right)^2 \left(\frac{df}{dt}\right)^2$$

If T=10 ms; s=1 m; I=10 sA and df/dt=100 per sec, then the present limit for the power of an airborne radiator is:

$$P_{max} = \frac{377}{2}\left(\frac{1\times10^8}{4\times3\times10^8}\right)^2\times(100)^2 = 1.3\times10^4\ \text{W} = 13\ \text{kW}$$

A ship could easily produce ten times this power.

To obtain some idea about the driving voltage required, consider the radiation of the power $P_t$=1 W with an antenna of length S=1 m and I=490 kA:

$$v = \frac{P_t}{I} = \frac{1}{4.9\times10^5} = 2.0\times10^{-6}\ \text{V} = 2.0\ \mu\text{V}$$

Note that this is only the voltage required to radiate the power of 1 W. An additional voltage is required to build up the near field, which energy is not radiated but flows back into the radiator at the end of the pulse. The ohmic resistance of the radiator will also require a significant voltage. Furthermore, the reduction of the antenna current of 490 kA to the much lower driver current implies a corresponding increase of the driving voltage.

A few words should be said about the cross-section of the high permeability cylindrical shield 75 around the return loops in FIG. 2A and FIG. 2B. This cross section must be large enough to prevent saturation and thus a decrease of the permeability. The theory for the determination of the cross-section is presented in books on transformers. It depends on the radiated power, the pulse duration, and the properties of the high-permeability material. Since books on transformers use frequency f instead of pulse duration T, f=1/2T should be used as a first approximation. Hence, for T=10 ms, f=50 Hz. A transformer for 50 or 60 Hz handling 1 kW of power has a cross-section of the iron core for the magnetic flux on the order of 10 $cm^2=10^{-3}$ $m^2$. If s in FIG. 2B equals 1 m, the required cross-section is $10^{-3}$ m/1=0.001 m=1 mm. The diameter of the cylinder is twice this value plus the diameter of the hole for the return loop RL. Mechanical considerations will be more important than magnetic saturation for the design of the high permeability cylinder.

For a land based radiator, the length s can be increased to 1 km or even 10 km without actually building a radiator according to FIG. 2B. Let s in FIG. 2A be 10 m, which is quite practical for a land based antenna. Instead of increasing s to 1 km by using the technique of FIG. 2B, 100 radiators of the type shown in FIG. 2A can be placed side by side, as shown in FIG. 9. The result is an array 10 m high and 1 km long that looks like a wall. By driving current not in parallel, but in series, through the 100 radiators, no increase in the driving current is required, but the driving voltage must be increased by a factor $100^2=10^4$, which is a decisive advantage. The radiated power increases by a factor $10^4$. Several (e.g., 10) such arrays can also be built, not necessarily close together but, for example, spread over an area of 30 km .times. 30 km=900 $km^2$. A time of 100 μs is then required to make all radiators interact. After this time the radiated power will have increased by a factor $10^2$.

Consider the power limitations for a land based radiator. Let s be 10 m for one radiator. A line of 100 such radiators:

$$P_{max} = \frac{377\Omega}{2}\left(\frac{10\cdot100\cdot10\cdot1\cdot M\cdot10^8\cdot A}{4\cdot3\cdot10^8\cdot\frac{m}{s}}\right)^2\cdot\left(100\cdot\frac{1}{s}\right)^2 = 1.309\times10^{12}\ \text{W} = 13\ \text{TW}$$

This assumes 10 arrays*100 elements long×10 elements high, lm length per element, 1 Million amps per element.

Hence the radiable power is no longer a limitation for land-based radiators of slowly varying waves.

Note, however, that the apparatus may be used employing alternative embodiments for the array elements 103. Other large current radiators are known, and any suitable large current radiator may be employed.

Figure 3:
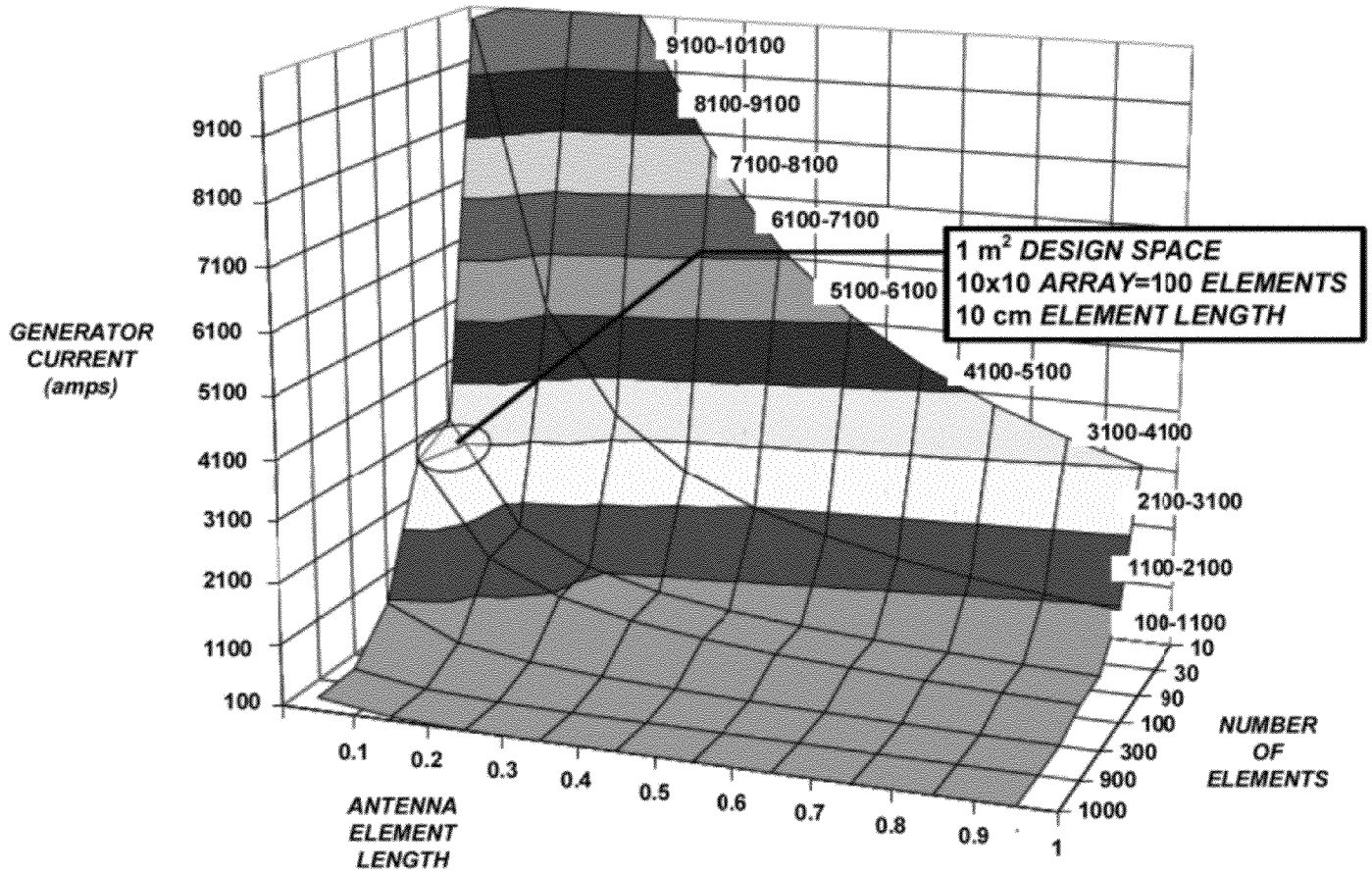
FIG. 3 maps one particular design space as a function of the generator current, the antenna element length, and the number of elements.
Figure 4:
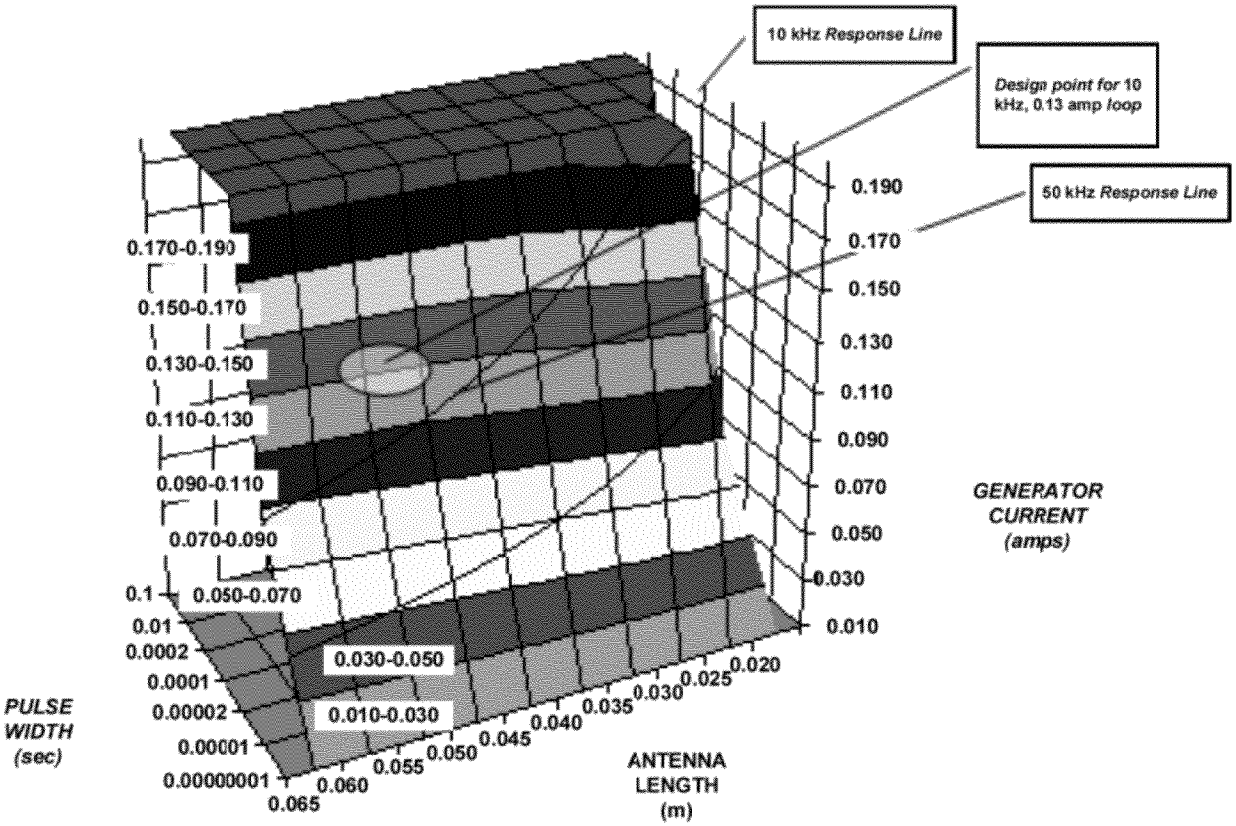
FIG. 4 maps a second particular design space as a function of pulse width, antenna length, and generator current.

The present invention admits wide latitude in certain aspects of the invention depending on implementation specific requirements. Among these aspects are the number of array elements 103, the size of the array elements 103, the amount of current used to drive them, the number of loops per array element, 103, etc. FIG. 3 maps one particular design space as a function of the generator current, the antenna element length, and the number of elements. More particularly, FIG. 3 illustrates a 1 $kW/cm^2$ generator requirement (amps) performance space at a 30 meter range, assuming 1 loop per element, 1:1 current transformer, and a 170 ns pulse. FIG. 4 maps a second particular design space as a function of pulse width, antenna length, and generator current. The design space of FIG. 4 contemplates a constant power density for a 0.13 amp loop at 2 meters using a 5 cm shielded loop element.

Figure 5:
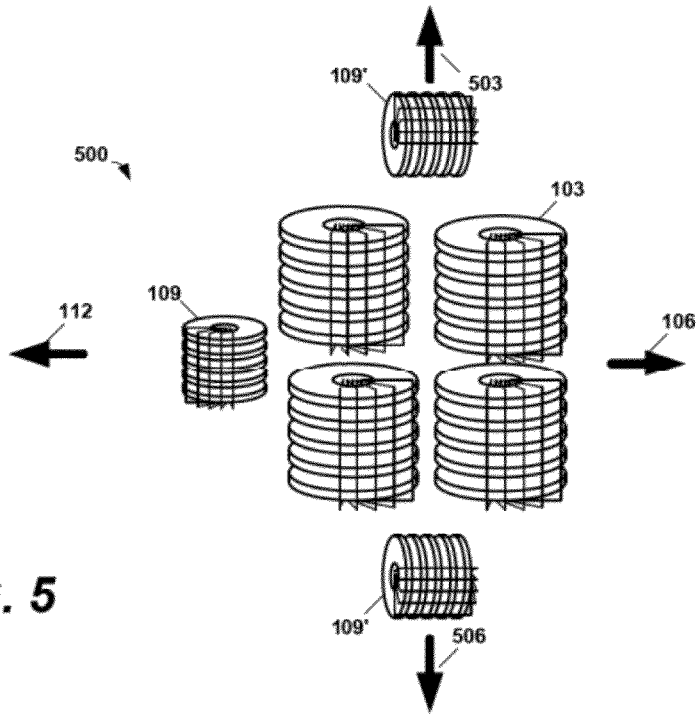
FIG. 5 illustrates the embodiment of FIG. 1 modified to implement the active cancelation technique disclosed herein to actively cancel undesirable side lobes.

Those in the art having the benefit of this disclosure will also appreciate that the active cancelation technique disclosed above can also be used to actively cancel undesirable side lobes in some embodiments. FIG. 5 illustrates the embodiment of FIG. 1 modified to implement one such embodiment. In FIG. 5, the apparatus 500 employs two canceling elements 109' to cancel undesirable side lobes in the directions 503, 506.

In the embodiment of FIG. 1, the array elements 103 and the canceling element 109 are all of the same kind—i.e., multi-turn loop element 203, as shown in FIG. 2B. In alternative embodiments, they may all be sheet elements 200, as shown in FIG. 2A. Still other alternative embodiments may "mix and match" different kinds of elements. Thus, some embodiments may mix different kinds of elements—e.g., the array elements may be multi-turn loop elements 203 while the canceling element 109 is a sheet element 200 and vice versa. Still other combinations will become apparent to those skilled in the art having the benefit of this disclosure. Note that in some embodiments design constraints might dictate that certain elements be sheet elements 200.

Those in the art will appreciate that the wave front (not shown) will typically comprise multiple lobes, only one of which will propagate in the direction 106. For example, the wavefront will include side lobes or a rear lobe. These lobes are called "spurious" herein because they are undesirable. In high energy applications, they might even prove dangerous to personnel operating the low frequency directional array 100. Accordingly, depending on the embodiment, the canceling element 109 radiates a second wavefront that actively "cancels" the spurious lobe. In the embodiment of FIG. 1, the canceling element 109 radiates a second wavefront (not shown) propagating in the direction of the arrow 112 to cancel the rear lobe (not shown). In alternative embodiments, the canceling element 109 can be used to actively cancel one or more of the side lobes (not shown) by moving the location of the canceling element 109 relative to the array elements 103. Other embodiments may employ multiple canceling elements 109 to actively cancel multiple spurious lobes.

The low frequency directional array 100 and its constituent parts are "capable of" their various functionalities in the sense that they perform their function when properly powered and controlled but do not do so in the absence of power and control. Thus, in operation, the low frequency directional array 100 performs a method, comprising: imparting a low frequency, directed wavefront; and actively canceling a spurious lobe of the wavefront. The low frequency directional array 100 is otherwise "capable of" performing those methods.

The technique disclosed herein is particularly suitable for applications in area denial as are described above. However, the apparatus is not limited for such uses and may be used in other applications. For example, the apparatus may be employed as a sensor in a variety of contexts such as ground penetrating RADAR and geophysical sensing.

The following documents are hereby incorporated by reference in their entirety and for all purposes as if set forth herein verbatim.:

U.S. Pat. No. 5,307,081, entitled "Radiator for Slowly Varying Electromagnetic Waves", and issued Apr. 26, 1994, to Geophysical Survey Systems, Inc. in the name of the inventor Henry F. Harmuth.

U.S. Provisional Application 61/085,245, entitled "Low Frequency Directed Energy Shielding", in the name of the inventor J. Richard Wood, and filed Jul. 31, 2008.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A low frequency directional array, comprising:

a plurality of array elements capable of generating a low frequency, area denial directed energy wavefront; and a canceling element capable of actively canceling a spurious lobe of the wavefront when the wavefront is generated to shield an area from the generated wavefront.

2. The low frequency directional array of claim 1, wherein the array elements comprise a plurality of multi-turn loop elements.

3. The low frequency directional array of claim 1, wherein the array elements comprise a plurality of sheet elements.

4. The low frequency directional array of claim 1, wherein the array elements comprise a plurality of multi-turn loop elements and a plurality of sheet elements.

5. The low frequency directional array of claim 1, wherein the canceling element comprises a multi-turn loop element.

6. The low frequency directional array of claim 1, wherein the canceling element comprises a sheet element.

7. The low frequency directional array of claim 1, where the array elements and the canceling element are the same kind of element.

8. The low frequency directional array of claim 1, where the array elements and the canceling element are the different kinds of elements.

9. The low frequency directional array of claim 1, wherein the spurious lobe is a side lobe.

10. The low frequency directional array of claim 1, wherein the spurious lobe is a back lobe.

11. A method, comprising:

imparting a low frequency, directed wavefront;

shielding a first area from the imparted wavefront by actively canceling a spurious lobe of the imparted wavefront; and denying a second area with the directed wavefront.

12. The method of claim 11, wherein actively canceling the spurious lobe includes actively canceling a side lobe of the wavefront.

13. The method of claim 11, wherein actively canceling the spurious lobe includes actively canceling a back lobe of the wavefront.

* * * * *